US011676612B2

(12) United States Patent
Vasilache et al.

(10) Patent No.: US 11,676,612 B2
(45) Date of Patent: Jun. 13, 2023

(54) DETERMINATION OF SPATIAL AUDIO PARAMETER ENCODING AND ASSOCIATED DECODING

(71) Applicant: Nokia Technologies Oy, Espoo (FI)

(72) Inventors: Adriana Vasilache, Tampere (FI); Anssi Rämö, Tampere (FI); Lasse Laaksonen, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 92 days.

(21) Appl. No.: 17/257,813

(22) PCT Filed: Jun. 20, 2019

(86) PCT No.: PCT/FI2019/050484
§ 371 (c)(1),
(2) Date: Jan. 4, 2021

(87) PCT Pub. No.: WO2020/008105
PCT Pub. Date: Jan. 9, 2020

(65) Prior Publication Data

US 2021/0295855 A1 Sep. 23, 2021

(30) Foreign Application Priority Data

Jul. 5, 2018 (GB) ..... 1811071

(51) Int. Cl.
*G10L 19/02* (2013.01)
*G10L 19/002* (2013.01)
(Continued)

(52) U.S. Cl.
CPC ..... *G10L 19/0204* (2013.01); *G10L 19/002* (2013.01); *G10L 19/008* (2013.01); *G10L 19/038* (2013.01)

(58) Field of Classification Search
CPC . G10L 19/002; G10L 19/0204; G10L 19/008; G10L 19/038
See application file for complete search history.

(56) References Cited

U.S. PATENT DOCUMENTS

2012/0259622 A1 10/2012 Liu et al.
2014/0219459 A1 8/2014 Daniel et al.
2019/0013028 A1* 1/2019 Atti ..... G10L 19/02

FOREIGN PATENT DOCUMENTS

CN 103928030 A 7/2014
CN 104464742 A 3/2015
(Continued)

OTHER PUBLICATIONS

Daniel, Adrien, Rozenn Nicol, and Stephen McAdams. "Parametric Spatial Audio Coding Based on Spatial Auditory Blurring." Audio Engineering Society Conference: 45th International Conference: Applications of Time-Frequency Processing in Audio. Audio Engineering Society, 2012.*

(Continued)

*Primary Examiner* — Paras D Shah
(74) *Attorney, Agent, or Firm* — Alston & Bird LLP

(57) ABSTRACT

An apparatus comprising means for: receiving values for sub-bands of a frame of an audio signal, the values comprising at least one azimuth value, at least one elevation value and at least one energy ratio value for each sub-band; determining an allocation of first number of bits to encode the values of the frame, wherein the first number of bits are fixed; encoding the at least one energy ratio value for a frame based on a defined allocation of a second number of bits from the first number of bits; encoding the at least one azimuth value and/or at least one elevation value of the frame based on a defined allocation of a third number of bits (Continued)

from the first number of bits, wherein the third number of bits is variably distributed on a sub-band-by-sub-band basis.

17 Claims, 6 Drawing Sheets

(51) Int. Cl.
*G10L 19/008* (2013.01)
*G10L 19/038* (2013.01)

(56) References Cited

FOREIGN PATENT DOCUMENTS

| | | | | | |
|---|---|---|---|---|---|
| FR | 3048808 | A1 | | 9/2017 | |
| WO | 2017/153697 | A1 | | 9/2017 | |
| WO | WO-2017153697 | A1 | * | 9/2017 | ..... G10L 19/008 |
| WO | WO-2019097018 | A1 | * | 5/2019 | ..... H03M 7/3082 |
| WO | 2019/243670 | A1 | | 12/2019 | |

OTHER PUBLICATIONS

Yang, Cheng, et al. "3D audio coding approach based on spatial perception features." China Communications 14.11 (2017): 126-140.*

Office action received for corresponding Indian Patent Application No. 202147002448, dated Jan. 7, 2022, 5 pages.

Extended European Search Report received for corresponding European Patent Application No. 19829906.7, dated Mar. 7, 2022, 5 pages.

Daniel et al., "Parametric Spatial Audio Coding Based on Spatial Auditory Blurring", AES 45th International Conference: Applications of Time-Frequency Processing in Audio, Mar. 1-4, 2012, pp. 1-10.

Search Report received for corresponding United Kingdom Application No. 1811071.8, dated Jan. 7, 2019, 4 pages.

International Search Report and Written Opinion received for corresponding Patent Cooperation Treaty Application No. PCT/FI2019/050484, dated Nov. 26, 2019, 14 pages.

Gao et al., "Azimuthal Perceptual Resolution Model Based Adaptive 3D Spatial Parameter Coding", International Conference on Multimedia Modeling, 2015, pp. 534-545.

* cited by examiner

Figure 5

501 Obtain metadata (azimuth values, elevation values, energy ratios)

503 Estimate the initial bit allocation for the directional information based on the energy ratio values 505 Reduce the allocated number of bits, bits_dir1[0:N-1][0:M-1] (the sum of the allocated bits = number of available bits left available for decoding the directional information)

507 Read one bit to tell if all elevation data is 0 or not (2D data)

509

If directional data is 3D
Count number of bit available for last subband (nb_last)
If (nb_last ==0) then last_j = N-1 Else Last_j = N
For each subband from j=1: last_j-1
Read 1 bit to tell is the encoding was fixed rate or variable rate
If fixed rate encoding:
Read and decode the spherical indexes for the directional information, obtaining the elevation and azimuth values and reduce 1 bit from the bits for the next subband;
else read and decode the entropy encoded indexes for elevation and azimuth, Count the number of bits used in the entropy encoded information, Calculate the difference between the allowed bits for the current subband and the bits used in the entropy encoding and Distribute the difference bits for the next subband
End for
For each suband from j = last_j:N: Read end decode fixed rate encoded spherical indexes for the directional data End for

511

If directional data 2D For each subband from j=1:N: Decode fixed rate encoded azimuth indexes; End for

DETERMINATION OF SPATIAL AUDIO PARAMETER ENCODING AND ASSOCIATED DECODING

RELATED APPLICATION

This application claims priority to PCT Application No. PCT/FI2019/050484, filed on Jun. 20, 2019, which claims priority to GB Application No. 1811071.8, filed on Jul. 5, 2018, each of which is incorporated herein by reference in its entirety.

FIELD

The present application relates to apparatus and methods for sound-field related parameter encoding, but not exclusively for time-frequency domain direction related parameter encoding for an audio encoder and decoder.

BACKGROUND

Parametric spatial audio processing is a field of audio signal processing where the spatial aspect of the sound is described using a set of parameters. For example, in parametric spatial audio capture from microphone arrays, it is a typical and an effective choice to estimate from the microphone array signals a set of parameters such as directions of the sound in frequency bands, and the ratios between the directional and non-directional parts of the captured sound in frequency bands. These parameters are known to well describe the perceptual spatial properties of the captured sound at the position of the microphone array. These parameters can be utilized in synthesis of the spatial sound accordingly, for headphones binaurally, for loudspeakers, or to other formats, such as Ambisonics.

The directions and direct-to-total energy ratios in frequency bands are thus a parameterization that is particularly effective for spatial audio capture.

A parameter set consisting of a direction parameter in frequency bands and an energy ratio parameter in frequency bands (indicating the directionality of the sound) can be also utilized as the spatial metadata (which may also include other parameters such as coherence, spread coherence, number of directions, distance etc) for an audio codec. For example, these parameters can be estimated from microphone-array captured audio signals, and for example a stereo signal can be generated from the microphone array signals to be conveyed with the spatial metadata. The stereo signal could be encoded, for example, with an AAC encoder. A decoder can decode the audio signals into PCM signals, and process the sound in frequency bands (using the spatial metadata) to obtain the spatial output, for example a binaural output.

The aforementioned solution is particularly suitable for encoding captured spatial sound from microphone arrays (e.g., in mobile phones, VR cameras, stand-alone microphone arrays). However, it may be desirable for such an encoder to have also other input types than microphone-array captured signals, for example, loudspeaker signals, audio object signals, or Ambisonic signals.

Analysing first-order Ambisonics (FOA) inputs for spatial metadata extraction has been thoroughly documented in scientific literature related to Directional Audio Coding (DirAC) and Harmonic planewave expansion (Harpex). This is since there exist microphone arrays directly providing a FOA signal (more accurately: its variant, the B-format signal), and analysing such an input has thus been a point of study in the field.

A further input for the encoder is also multi-channel loudspeaker input, such as 5.1 or 7.1 channel surround inputs.

However with respect to the directional components of the metadata, which may comprise an elevation, azimuth (and energy ratio which is 1-diffuseness) of a resulting direction, for each considered time/frequency subband. Quantization of these directional components is a current research topic.

SUMMARY

There is provided according to a first aspect an apparatus comprising means for: receiving values for sub-bands of a frame of an audio signal, the values comprising at least one azimuth value, at least one elevation value and at least one energy ratio value for each sub-band; determining an allocation of first number of bits to encode the values of the frame, wherein the first number of bits is fixed; encoding the at least one energy ratio value of the frame based on a defined allocation of a second number of bits from the first number of bits; encoding the at least one azimuth value and/or at least one elevation value of the frame based on a defined allocation of a third number of bits from the first number of bits, wherein the third number of bits is variably distributed on a sub-band-by-sub-band basis.

The means for encoding the at least one energy ratio values of the frame based on a defined allocation of a second number of bits from the first number of bits may be further for: generating a weighted average of the at least one energy ratio value; encoding the weighted average of the at least one energy ratio value based on the second number of bits.

The means for encoding the weighted average of the at least one energy ratio value based on the second number of bits may be further for scalar non-uniform quantizing the at least one weighted average of the at least one energy ratio value.

The means for encoding at least one azimuth value and/or at least one elevation value of the frame based on a defined allocation of a third number of bits from the first number of bits, wherein the third number of bits is variably distributed on a sub-band-by-sub-band basis may be further for: determining an initial estimate for the distribution of the third number of bits on a sub-band-by-sub-band basis, the initial estimate based on the at least one energy ratio value associated with the sub-band; spatial quantizing the at least one azimuth value and/or at least one elevation value based on the initial estimate for the distribution of the third number of bits on a sub-band-by-sub-band basis to generate at least one azimuth index and/or at least one elevation index for each sub-band.

The means for encoding the at least one azimuth value and/or at least one elevation value of the frame based on a defined allocation of a third number of bits from the first number of bits, wherein the third number of bits is variably distributed on a sub-band-by-sub-band basis may be further for encoding on a sub-band-by-sub-band basis by determining a reduced distribution of the third number of bits on a sub-band-by-sub-band basis, the reduced estimate based on the initial estimate and the defined allocation of the second number of bits.

The means for encoding the at least one azimuth value and/or at least one elevation value of the frame based on a defined allocation of a third number of bits from the first number of bits, wherein the third number of bits is variably distributed on a sub-band-by-sub-band basis may be further for encoding on a sub-band-by-sub-band basis by: determining an allocation of bits for encoding the at least one azimuth index and/or at least one elevation index for a sub-band based on the reduced distribution; estimating a number of bits required to entropy encode the at least one azimuth index and/or at least one elevation index; entropy encoding the at least one azimuth index and/or at least one elevation index based on the number of bits required to entropy encode the at least one azimuth index and/or at least one elevation index being less than the allocation of bits for encoding the at least one azimuth index and/or at least one elevation index for a sub-band and fixed rate encoding based on the allocation of bits otherwise; generate a signalling bit identifying the encoding of the at least one azimuth index and/or at least one elevation index; distributing any available bits from the difference of the allocation of bits for encoding the at least one azimuth index and/or at least one elevation index for a sub-band and the sum of the number of bits encoding the sub-band and the signalling bit for further allocation of bits for encoding the at least one azimuth index and/or at least one elevation index for a further sub-band or decreasing a further allocation of bits for encoding the at least one azimuth index and/or at least one elevation index for a further sub-band by one bit otherwise.

The means for encoding the at least one azimuth value and/or at least one elevation value of the frame based on a defined allocation of a third number of bits from the first number of bits, wherein the third number of bits is variably distributed on a sub-band-by-sub-band basis may be further for encoding on a sub-band-by-sub-band basis by: determining an allocation of bits for encoding the at least one azimuth index and/or at least one elevation index for a last sub-band based on the reduced distribution; and fixed rate encoding the at least one azimuth index and/or at least one elevation index for a last sub-band based on the reduced distribution allocation of bits.

The means for entropy encoding the at least one azimuth index and/or at least one elevation index based on the number of bits required to entropy encode the at least one azimuth index and/or at least one elevation index may be means for Golomb Rice encoding with two GR parameter values.

The means for encoding on a sub-band-by-sub-band basis by determining a reduced distribution of the third number of bits on a sub-band-by-sub-band basis, the reduced estimate based on the initial estimate and the defined allocation of the second number of bits may be further for uniformly reducing on a sub-band-by-sub-band basis an allocation of bits for encoding the at least one azimuth index and/or at least one elevation index.

The means for encoding the at least one azimuth value and/or at least one elevation value of the frame based on a defined allocation of a third number of bits from the first number of bits, wherein the third number of bits is variably distributed on a sub-band-by-sub-band basis may be further for at least one of: assigning indexes for encoding in increasing order of the distance from the frontal direction; assigning the index in increasing order of the azimuth value.

The means for may be further for: storing and/or transmitting the encoded at least one energy ratio value and at least one azimuth value and/or at least one elevation value.

According to a second aspect there is provided an apparatus comprising means for: receiving encoded values for sub-bands of a frame of an audio signal, the values comprising at least one azimuth index, at least one elevation index and at least one energy ratio value for each sub-band; decoding the encoded values of the frame based on a defined allocation of bits wherein decoding the at least one azimuth index and/or at least one elevation index of the frame uses a variably distributed bit allocation on a sub-band-by-sub-band basis.

The means for decoding the encoded values of the frame based on a defined allocation of bits wherein decoding the at least one azimuth index and/or at least one elevation index of the frame uses a variably distributed bit allocation on a sub-band-by-sub-band basis may be further for: determining an initial allocation of bits distribution used to decode the at least one azimuth index and/or at least one elevation index for each sub-band based on the at least one energy ratio value for each sub-band; determining a reduced allocation of bits distribution based on the initial allocation of bits distribution and an allocation of bits distribution for decoding at least one energy ratio value of the frame; and decoding the at least one azimuth index and/or at least one elevation index of the frame based on the reduced allocation of bits distribution.

The means for decoding the at least one azimuth index and/or at least one elevation index of the frame based on the reduced allocation of bits distribution may be further for: determining an allocation of bits for decoding the at least one azimuth index and/or at least one elevation index for a sub-band based on the reduced distribution; entropy decoding the at least one azimuth index and/or at least one elevation index based on a signalling bit indicating entropy encoding and fixed rate decoding otherwise; distributing any available bits from the difference of the allocation of bits for decoding the at least one azimuth index and/or at least one elevation index for a sub-band and the sum of the number of bits decoding the sub-band and the signalling bit for further allocation of bits for decoding the at least one azimuth index and/or at least one elevation index for a further sub-band or decreasing a further allocation of bits for decoding the at least one azimuth index and/or at least one elevation index for a further sub-band by one bit otherwise.

The means for decoding the at least one azimuth index and/or at least one elevation index of the frame based on the reduced allocation of bits distribution may be further for: determining an allocation of bits for decoding the at least one azimuth index and/or at least one elevation index for a last sub-band based on the reduced distribution; and fixed rate decoding the at least one azimuth index and/or at least one elevation index for a last sub-band based on the reduced distribution allocation of bits.

The means for entropy decoding the at least one azimuth index and/or at least one elevation index may be means for Golomb Rice decoding with two GR parameter values.

According to a third aspect there is provided a method comprising: receiving values for sub-bands of the frame, the values comprising at least one azimuth value, at least one elevation value and at least one energy ratio value for each sub-band; determining an allocation of first number of bits to encode the values of the frame, wherein the first number of bits are fixed; encoding at least one energy ratio value of the frame based on a defined allocation of a second number of bits from the first number of bits; encoding the at least one azimuth value and/or at least one elevation value of the frame based on a defined allocation of a third number of bits from the first number of bits, wherein the third number of bits is variably distributed on a sub-band-by-sub-band basis.

Encoding the at least one energy ratio values of the frame based on a defined allocation of a second number of bits from the first number of bits may further comprise: generating a weighted average of the at least one energy ratio value; encoding the weighted average of the at least one energy ratio value based on the second number of bits.

Encoding the weighted average of the at least one energy ratio value based on the second number of bits may further comprise scalar non-uniform quantizing the at least one weighted average of the at least one energy ratio value.

Encoding the at least one azimuth value and/or at least one elevation value of the frame based on a defined allocation of a third number of bits from the first number of bits, wherein the third number of bits is variably distributed on a sub-band-by-sub-band basis may further comprise: determining an initial estimate for the distribution of the third number of bits on a sub-band-by-sub-band basis, the initial estimate based on the at least one energy ratio value associated with the sub-band; spatial quantizing the at least one azimuth value and/or at least one elevation value based on the initial estimate for the distribution of the third number of bits on a sub-band-by-sub-band basis to generate at least one azimuth index and/or at least one elevation index for each sub-band.

Encoding the at least one azimuth value and/or at least one elevation value of the frame based on a defined allocation of a third number of bits from the first number of bits, wherein the third number of bits is variably distributed on a sub-band-by-sub-band basis may further comprise encoding on a sub-band-by-sub-band basis by determining a reduced distribution of the third number of bits on a sub-band-by-sub-band basis, the reduced estimate based on the initial estimate and the defined allocation of the second number of bits.

Encoding the at least one azimuth value and/or at least one elevation value of the frame based on a defined allocation of a third number of bits from the first number of bits, wherein the third number of bits is variably distributed on a sub-band-by-sub-band basis may further comprise encoding on a sub-band-by-sub-band basis by: determining an allocation of bits for encoding the at least one azimuth index and/or at least one elevation index for a sub-band based on the reduced distribution; estimating a number of bits required to entropy encode the at least one azimuth index and/or at least one elevation index; entropy encoding the at least one azimuth index and/or at least one elevation index based on the number of bits required to entropy encode the at least one azimuth index and/or at least one elevation index being less than the allocation of bits for encoding the at least one azimuth index and/or at least one elevation index for a sub-band and fixed rate encoding based on the allocation of bits otherwise; generating a signalling bit identifying the encoding of the at least one azimuth index and/or at least one elevation index; distributing any available bits from the difference of the allocation of bits for encoding the at least one azimuth index and/or at least one elevation index for a sub-band and the sum of the number of bits encoding the sub-band and the signalling bit for further allocation of bits for encoding the at least one azimuth index and/or at least one elevation index for a further sub-band or decreasing a further allocation of bits for encoding the at least one azimuth index and/or at least one elevation index for a further sub-band by one bit otherwise.

Encoding the at least one azimuth value and/or at least one elevation value of the frame based on a defined allocation of a third number of bits from the first number of bits, wherein the third number of bits is variably distributed on a sub-band-by-sub-band basis may further comprise encoding on a sub-band-by-sub-band basis by: determining an allocation of bits for encoding the at least one azimuth index and/or at least one elevation index for a last sub-band based on the reduced distribution; and fixed rate encoding the at least one azimuth index and/or at least one elevation index for a last sub-band based on the reduced distribution allocation of bits.

Entropy encoding the at least one azimuth index and/or at least one elevation index based on the number of bits required to entropy encode the at least one azimuth index and/or at least one elevation index may further comprise Golomb Rice encoding with two GR parameter values.

Encoding on a sub-band-by-sub-band basis by determining a reduced distribution of the third number of bits on a sub-band-by-sub-band basis, the reduced estimate based on the initial estimate and the defined allocation of the second number of bits may further comprise uniformly reducing on a sub-band-by-sub-band basis an allocation of bits for encoding the at least one azimuth index and/or at least one elevation index.

Encoding the at least one azimuth value and/or at least one elevation value of the frame based on a defined allocation of a third number of bits from the first number of bits, wherein the third number of bits is variably distributed on a sub-band-by-sub-band basis may further comprise at least one of: assigning indexes for encoding in increasing order of the distance from the frontal direction; assigning the index in increasing order of the azimuth value.

The method may further comprise: storing and/or transmitting the encoded at least one energy ratio value and at least one azimuth value and/or at least one elevation value of the frame.

According to a fourth aspect there is provided a method comprising: receiving encoded values for sub-bands of a frame of an audio signal, the values comprising at least one azimuth index, at least one elevation index and at least one energy ratio value for each sub-band; decoding encoded values of the frame based on a defined allocation of bits wherein decoding the at least one azimuth index and/or at least one elevation index of the frame uses a variably distributed bit allocation on a sub-band-by-sub-band basis.

Decoding the at least one azimuth index and/or at least one elevation index of the frame uses a variably distributed bit allocation on a sub-band-by-sub-band basis may further comprise: determining an initial allocation of bits distribution used to decode the at least one azimuth index and/or at least one elevation index for each sub-band based on the at least one energy ratio value for each sub-band; determining a reduced allocation of bits distribution based on the initial allocation of bits distribution and an allocation of bits distribution for decoding at least one energy ratio value of the frame; and decoding the at least one azimuth index and/or at least one elevation index of the frame based on the reduced allocation of bits distribution.

Decoding the at least one azimuth index and/or at least one elevation index of the frame based on the reduced allocation of bits distribution may further comprise: determining an allocation of bits for decoding the at least one azimuth index and/or at least one elevation index for a sub-band based on the reduced distribution; entropy decoding the at least one azimuth index and/or at least one elevation index based on a signalling bit indicating entropy encoding and fixed rate decoding otherwise; distributing any available bits from the difference of the allocation of bits for decoding the at least one azimuth index and/or at least one elevation index for a sub-band and the sum of the number of bits decoding the sub-band and the signalling bit for further allocation of bits for decoding the at least one azimuth index and/or at least one elevation index for a further sub-band or decreasing a further allocation of bits for decoding the at least one azimuth index and/or at least one elevation index for a further sub-band by one bit otherwise.

Decoding the at least one azimuth index and/or at least one elevation index of the frame based on the reduced allocation of bits distribution may further comprise: determining an allocation of bits for decoding the at least one azimuth index and/or at least one elevation index for a last sub-band based on the reduced distribution; and fixed rate decoding the at least one azimuth index and/or at least one elevation index for a last sub-band based on the reduced distribution allocation of bits.

Entropy decoding the at least one azimuth index and/or at least one elevation index may further comprise Golomb Rice decoding with two GR parameter values.

According to a fifth aspect there is provided an apparatus comprising at least one processor and at least one memory including a computer program code, the at least one memory and the computer program code configured to, with the at least one processor, cause the apparatus at least to: receive values for sub-bands of a frame of an audio signal, the values comprising at least one azimuth value, at least one elevation value and at least one energy ratio value for each sub-band; determine an allocation of first number of bits to encode the values of the frame, wherein the first number of bits are fixed; encode at least one energy ratio value of the frame based on a defined allocation of a second number of bits from the first number of bits; encoding the at least one azimuth value and/or at least one elevation value of the frame based on a defined allocation of a third number of bits from the first number of bits, wherein the third number of bits is variably distributed on a sub-band-by-sub-band basis.

The apparatus caused to encode the at least one energy ratio values of the frame based on a defined allocation of a second number of bits from the first number of bits may further be caused to: generate a weighted average of the at least one energy ratio value; encode the weighted average of the at least one energy ratio value based on the second number of bits.

The apparatus caused to encode the weighted average of the at least one energy ratio value based on the second number of bits may further be caused to scalar non-uniform quantize the at least one weighted average of the at least one energy ratio value.

The apparatus caused to encode the at least one azimuth value and/or at least one elevation value of the frame based on a defined allocation of a third number of bits from the first number of bits, wherein the third number of bits is variably distributed on a sub-band-by-sub-band basis is further caused to: determine an initial estimate for the distribution of the third number of bits on a sub-band-by-sub-band basis, the initial estimate based on the at least one energy ratio value associated with the sub-band; spatial quantize the at least one azimuth value and/or at least one elevation value based on the initial estimate for the distribution of the third number of bits on a sub-band-by-sub-band basis to generate at least one azimuth index and/or at least one elevation index for each sub-band.

The apparatus caused to encode the at least one azimuth value and/or at least one elevation value of the frame based on a defined allocation of a third number of bits from the first number of bits, wherein the third number of bits is variably distributed on a sub-band-by-sub-band basis may further be caused to encode on a sub-band-by-sub-band basis by determining a reduced distribution of the third number of bits on a sub-band-by-sub-band basis, the reduced estimate based on the initial estimate and the defined allocation of the second number of bits.

The apparatus caused to encode the at least one azimuth value and/or at least one elevation value of the frame based on a defined allocation of a third number of bits from the first number of bits, wherein the third number of bits is variably distributed on a sub-band-by-sub-band basis may further be caused to encode on a sub-band-by-sub-band basis by performing: determine an allocation of bits for encoding the at least one azimuth index and/or at least one elevation index for a sub-band based on the reduced distribution; estimate a number of bits required to entropy encode the at least one azimuth index and/or at least one elevation index; entropy encode the at least one azimuth index and/or at least one elevation index based on the number of bits required to entropy encode the at least one azimuth index and/or at least one elevation index being less than the allocation of bits for encoding the at least one azimuth index and/or at least one elevation index for a sub-band and fixed rate encoding based on the allocation of bits otherwise; generate a signalling bit identifying the encoding of the at least one azimuth index and/or at least one elevation index; distribute any available bits from the difference of the allocation of bits for encoding the at least one azimuth index and/or at least one elevation index for a sub-band and the sum of the number of bits encoding the sub-band and the signalling bit for further allocation of bits for encoding the at least one azimuth index and/or at least one elevation index for a further sub-band or decreasing a further allocation of bits for encoding the at least one azimuth index and/or at least one elevation index for a further sub-band by one bit otherwise.

The apparatus caused to encode the at least one azimuth value and/or at least one elevation value of the frame based on a defined allocation of a third number of bits from the first number of bits, wherein the third number of bits is variably distributed on a sub-band-by-sub-band basis may further be caused to encode on a sub-band-by-sub-band basis by performing: determine an allocation of bits for encoding the at least one azimuth index and/or at least one elevation index for a last sub-band based on the reduced distribution; and fixed rate encode the at least one azimuth index and/or at least one elevation index for a last sub-band based on the reduced distribution allocation of bits.

The apparatus caused to entropy encode the at least one azimuth index and/or at least one elevation index based on the number of bits required to entropy encode the at least one azimuth index and/or at least one elevation index may further be caused to Golomb Rice encode with two GR parameter values.

The apparatus caused to encode on a sub-band-by-sub-band basis by determining a reduced distribution of the third number of bits on a sub-band-by-sub-band basis, the reduced estimate based on the initial estimate and the defined allocation of the second number of bits may further be caused to uniformly reduce on a sub-band-by-sub-band basis an allocation of bits for encoding the at least one azimuth index and/or at least one elevation index.

The apparatus caused to encode the at least one azimuth value and/or at least one elevation value of the frame based on a defined allocation of a third number of bits from the first number of bits, wherein the third number of bits is variably distributed on a sub-band-by-sub-band basis may further be caused to perform at least one of: assign indexes for encoding in increasing order of the distance from the frontal direction; assign the index in increasing order of the azimuth value.

The apparatus may be further caused to perform: store and/or transmit the encoded at least one energy ratio value and at least one azimuth value and/or at least one elevation value of the frame.

According to a sixth aspect there is provided an apparatus comprising at least one processor and at least one memory including a computer program code, the at least one memory and the computer program code configured to, with the at least one processor, cause the apparatus at least to: receive encoded values for sub-bands of a frame of an audio signal, the values comprising at least one azimuth index, at least one elevation index and at least one energy ratio value for each sub-band; decode the encoded values of the frame based on a defined allocation of bits wherein decoding the at least one azimuth index and/or at least one elevation index of the frame uses a variably distributed bit allocation on a sub-band-by-sub-band basis.

The apparatus caused to decode the encoded values of the frame based on a defined allocation of bits wherein decoding the at least one azimuth index and/or at least one elevation index of the frame uses a variably distributed bit allocation on a sub-band-by-sub-band basis may further be caused to: determine an initial allocation of bits distribution used to decode the at least one azimuth index and/or at least one elevation index for each sub-band based on the at least one energy ratio value for each sub-band; determine a reduced allocation of bits distribution based on the initial allocation of bits distribution and an allocation of bits distribution for decoding at least one energy ratio value of the frame; and decode the at least one azimuth index and/or at least one elevation index of the frame based on the reduced allocation of bits distribution.

The apparatus caused to decode the at least one azimuth index and/or at least one elevation index of the frame based on the reduced allocation of bits distribution may further be caused to: determine an allocation of bits for decoding the at least one azimuth index and/or at least one elevation index for a sub-band based on the reduced distribution; entropy decode the at least one azimuth index and/or at least one elevation index based on a signalling bit indicating entropy encoding and fixed rate decoding otherwise; distribute any available bits from the difference of the allocation of bits for decoding the at least one azimuth index and/or at least one elevation index for a sub-band and the sum of the number of bits decoding the sub-band and the signalling bit for further allocation of bits for decoding the at least one azimuth index and/or at least one elevation index for a further sub-band or decrease a further allocation of bits for decoding the at least one azimuth index and/or at least one elevation index for a further sub-band by one bit otherwise.

The apparatus caused to decode the at least one azimuth index and/or at least one elevation index of the frame based on the reduced allocation of bits distribution may further be caused to: determine an allocation of bits for decoding the at least one azimuth index and/or at least one elevation index for a last sub-band based on the reduced distribution; and fixed rate decode the at least one azimuth index and/or at least one elevation index for a last sub-band based on the reduced distribution allocation of bits.

The apparatus caused to entropy decode the at least one azimuth index and/or at least one elevation index may further be caused to Golomb Rice decode with two GR parameter values.

According to a seventh aspect there is provided an apparatus comprising: means for receiving values for sub-bands for a frame of an audio signal, the values comprising at least one azimuth value, at least one elevation value and at least one energy ratio value for each sub-band; means for determining an allocation of first number of bits to encode the values of the frame, wherein the first number of bits are fixed; means for encoding the at least one energy ratio value of the frame based on a defined allocation of a second number of bits from the first number of bits; means for encoding the at least one azimuth value and/or at least one elevation value of the frame based on a defined allocation of a third number of bits from the first number of bits, wherein the third number of bits is variably distributed on a sub-band-by-sub-band basis.

According to an eighth aspect there is provided an apparatus comprising means for receiving encoded values for sub-bands for a frame of an audio signal, the values comprising at least one azimuth index, at least one elevation index and at least one energy ratio value for each sub-band; means for decoding encoded values of the frame based on a defined allocation of bits wherein decoding the at least one azimuth index and/or at least one elevation index of the frame uses a variably distributed bit allocation on a sub-band-by-sub-band basis.

According to a ninth aspect there is provided a computer program comprising instructions [or a computer readable medium comprising program instructions] for causing an apparatus to perform at least the following: receiving values for sub-bands of a frame of an audio signal, the values comprising at least one azimuth value, at least one elevation value and at least one energy ratio value for each sub-band; determining an allocation of first number of bits to encode the values of the frame, wherein the first number of bits are fixed; encoding the at least one energy ratio value of the frame based on a defined allocation of a second number of bits from the first number of bits; encoding the at least one azimuth value and/or at least one elevation value of the frame based on a defined allocation of a third number of bits from the first number of bits, wherein the third number of bits is variably distributed on a sub-band-by-sub-band basis.

According to a tenth aspect there is provided a computer program comprising instructions [or a computer readable medium comprising program instructions] for causing an apparatus to perform at least the following: receiving encoded values for sub-bands for a frame of an audio signal, the values comprising at least one azimuth index, at least one elevation index and at least one energy ratio value for each sub-band; decoding the encoded values of the frame based on a defined allocation of bits wherein decoding the at least one azimuth index and/or at least one elevation index of the frame uses a variably distributed bit allocation on a sub-band-by-sub-band basis.

According to an eleventh aspect there is provided a non-transitory computer readable medium comprising program instructions for causing an apparatus to perform at least the following: receiving values for sub-bands of a frame of an audio signal, the values comprising at least one azimuth value, at least one elevation value and at least one energy ratio value for each sub-band; determining an allocation of first number of bits to encode the values of the frame, wherein the first number of bits are fixed; encoding the at least one energy ratio value of the frame based on a defined allocation of a second number of bits from the first number of bits; encoding the at least one azimuth value and/or at least one elevation value of the frame based on a defined allocation of a third number of bits from the first number of bits, wherein the third number of bits is variably distributed on a sub-band-by-sub-band basis.

According to a twelfth aspect there is provided a non-transitory computer readable medium comprising program instructions for causing an apparatus to perform at least the following: receiving encoded values for sub-bands for a frame of an audio signal, the values comprising at least one azimuth index, at least one elevation index and at least one energy ratio value for each sub-band; decoding the encoded values of the frame based on a defined allocation of bits wherein decoding the at least one azimuth index and/or at least one elevation index of the frame uses a variably distributed bit allocation on a sub-band-by-sub-band basis.

According to a thirteenth aspect there is provided an apparatus comprising: receiving circuitry configured to receive values for sub-bands of a frame of an audio signal, the values comprising at least one azimuth value, at least one elevation value and at least one energy ratio value for each sub-band; allocation circuitry configured to determine an allocation of first number of bits to encode the values of the frame, wherein the first number of bits are fixed; encoding circuitry configured to encode the at least one energy ratio value of the frame based on a defined allocation of a second number of bits from the first number of bits; encoding circuitry configured to encode the at least one azimuth value and/or at least one elevation value of the frame based on a defined allocation of a third number of bits from the first number of bits, wherein the third number of bits is variably distributed on a sub-band-by-sub-band basis.

According to a fourteenth aspect there is provided an apparatus comprising: receiving circuitry configured to receive encoded values for sub-bands of a frame of an audio signal, the values comprising at least one azimuth index, at least one elevation index and at least one energy ratio value for each sub-band; decoding circuitry configured to decode the encoded values of the frame based on a defined allocation of bits wherein decoding the at least one azimuth index and/or at least one elevation index of the frame uses a variably distributed bit allocation on a sub-band-by-sub-band basis.

According to a fifteenth aspect there is provided a computer readable medium comprising program instructions for causing an apparatus to perform at least the following: receiving values for sub-bands of a frame of an audio signal, the values comprising at least one azimuth value, at least one elevation value and at least one energy ratio value for each sub-band; determining an allocation of first number of bits to encode the values of the frame, wherein the first number of bits are fixed; encoding the at least one energy ratio value of the frame based on a defined allocation of a second number of bits from the first number of bits; encoding the at least one azimuth value and/or at least one elevation value of the frame based on a defined allocation of a third number of bits from the first number of bits, wherein the third number of bits is variably distributed on a sub-band-by-sub-band basis.

According to a sixteenth aspect there is provided a computer readable medium comprising program instructions for causing an apparatus to perform at least the following: receiving encoded values for sub-bands of a frame of an audio signal, the values comprising at least one azimuth index, at least one elevation index and at least one energy ratio value for each sub-band; decoding the encoded values of the frame based on a defined allocation of bits wherein decoding the at least one azimuth index and/or at least one elevation index of the frame uses a variably distributed bit allocation on a sub-band-by-sub-band basis.

An apparatus comprising means for performing the actions of the method as described above.

An apparatus configured to perform the actions of the method as described above.

A computer program comprising program instructions for causing a computer to perform the method as described above.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which:

FIG. 5 show a flow diagram of the operation of a metadata decoder as shown in FIG. 4 according to some embodiments.

EMBODIMENTS OF THE APPLICATION

The following describes in further detail suitable apparatus and possible mechanisms for the provision of effective spatial analysis derived metadata parameters. In the following discussions multi-channel system is discussed with respect to a multi-channel microphone implementation. However as discussed above the input format may be any suitable input format, such as multi-channel loudspeaker, ambisonic (FOA/HOA) etc. It is understood that in some embodiments the channel location is based on a location of the microphone or is a virtual location or direction. Furthermore the output of the example system is a multi-channel loudspeaker arrangement. However it is understood that the output may be rendered to the user via means other than loudspeakers. Furthermore the multi-channel loudspeaker signals may be generalised to be two or more playback audio signals.

The metadata consists at least of elevation, azimuth and the energy ratio of a resulting direction, for each considered time/frequency subband. The direction parameter components, the azimuth and the elevation are extracted from the audio data and then quantized to a given quantization resolution. The resulting indexes must be further compressed for efficient transmission. For high bitrate, high quality lossless encoding of the metadata is needed.

The concept as discussed hereafter is to combine a fixed bitrate coding approach with variable bitrate coding that distributes encoding bits for data to be compressed between different segments, such that the overall bitrate per frame is fixed. Within the time frequency blocks, the bits can be transferred between frequency sub-bands.

Figure 1:
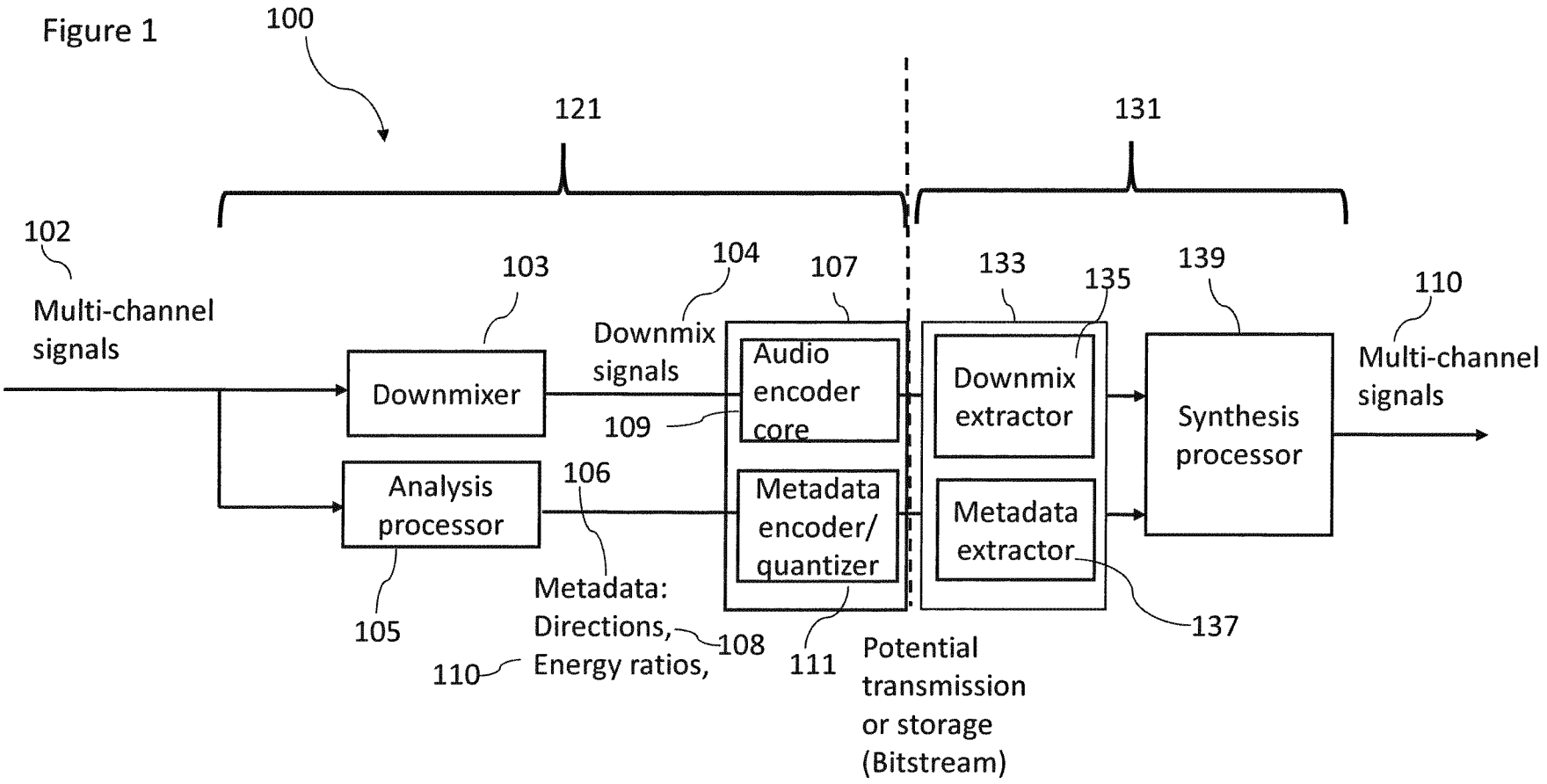
FIG. 1 shows schematically a system of apparatus suitable for implementing some embodiments.

With respect to FIG. 1 an example apparatus and system for implementing embodiments of the application are shown. The system 100 is shown with an 'analysis' part 121 and a 'synthesis' part 131. The 'analysis' part 121 is the part from receiving the multi-channel loudspeaker signals up to an encoding of the metadata and downmix signal and the 'synthesis' part 131 is the part from a decoding of the encoded metadata and downmix signal to the presentation of the re-generated signal (for example in multi-channel loudspeaker form).

The input to the system 100 and the 'analysis' part 121 is the multi-channel signals 102. In the following examples a microphone channel signal input is described, however any suitable input (or synthetic multi-channel) format may be implemented in other embodiments. For example in some embodiments the spatial analyser and the spatial analysis may be implemented external to the encoder. For example in some embodiments the spatial metadata associated with the audio signals may be a provided to an encoder as a separate bit-stream. In some embodiments the spatial metadata may be provided as a set of spatial (direction) index values.

The multi-channel signals are passed to a downmixer 103 and to an analysis processor 105.

In some embodiments the downmixer 103 is configured to receive the multi-channel signals and downmix the signals to a determined number of channels and output the downmix signals 104. For example the downmixer 103 may be configured to generate a 2 audio channel downmix of the multi-channel signals. The determined number of channels may be any suitable number of channels. In some embodiments the downmixer 103 is optional and the multi-channel signals are passed unprocessed to an encoder 107 in the same manner as the downmix signal are in this example.

In some embodiments the analysis processor 105 is also configured to receive the multi-channel signals and analyse the signals to produce metadata 106 associated with the multi-channel signals and thus associated with the downmix signals 104. The analysis processor 105 may be configured to generate the metadata which may comprise, for each time-frequency analysis interval, a direction parameter 108 and an energy ratio parameter 110 (and in some embodiments a coherence parameter, and a diffuseness parameter). The direction and energy ratio may in some embodiments be considered to be spatial audio parameters. In other words the spatial audio parameters comprise parameters which aim to characterize the sound-field created by the multi-channel signals (or two or more playback audio signals in general).

In some embodiments the parameters generated may differ from frequency band to frequency band. Thus for example in band X all of the parameters are generated and transmitted, whereas in band Y only one of the parameters is generated and transmitted, and furthermore in band Z no parameters are generated or transmitted. A practical example of this may be that for some frequency bands such as the highest band some of the parameters are not required for perceptual reasons. The downmix signals 104 and the metadata 106 may be passed to an encoder 107.

The encoder 107 may comprise an audio encoder core 109 which is configured to receive the downmix (or otherwise) signals 104 and generate a suitable encoding of these audio signals. The encoder 107 can in some embodiments be a computer (running suitable software stored on memory and on at least one processor), or alternatively a specific device utilizing, for example, FPGAs or ASICs. The encoding may be implemented using any suitable scheme. The encoder 107 may furthermore comprise a metadata encoder/quantizer 111 which is configured to receive the metadata and output an encoded or compressed form of the information. In some embodiments the encoder 107 may further interleave, multiplex to a single data stream or embed the metadata within encoded downmix signals before transmission or storage shown in FIG. 1 by the dashed line. The multiplexing may be implemented using any suitable scheme.

In the decoder side, the received or retrieved data (stream) may be received by a decoder/demultiplexer 133. The decoder/demultiplexer 133 may demultiplex the encoded streams and pass the audio encoded stream to a downmix extractor 135 which is configured to decode the audio signals to obtain the downmix signals. Similarly the decoder/demultiplexer 133 may comprise a metadata extractor 137 which is configured to receive the encoded metadata and generate metadata. The decoder/demultiplexer 133 can in some embodiments be a computer (running suitable software stored on memory and on at least one processor), or alternatively a specific device utilizing, for example, FPGAs or ASICs.

The decoded metadata and downmix audio signals may be passed to a synthesis processor 139.

The system 100 'synthesis' part 131 further shows a synthesis processor 139 configured to receive the downmix and the metadata and re-creates in any suitable format a synthesized spatial audio in the form of multi-channel signals 110 (these may be multichannel loudspeaker format or in some embodiments any suitable output format such as binaural or Ambisonics signals, depending on the use case) based on the downmix signals and the metadata.

Therefore in summary first the system (analysis part) is configured to receive multi-channel audio signals.

Then the system (analysis part) is configured to generate a downmix or otherwise generate a suitable transport audio signal (for example by selecting some of the audio signal channels).

The system is then configured to encode for storage/transmission the downmix (or more generally the transport signal.

After this the system may store/transmit the encoded downmix and metadata.

The system may retrieve/receive the encoded downmix and metadata.

Then the system is configured to extract the downmix and metadata from encoded downmix and metadata parameters, for example demultiplex and decode the encoded downmix and metadata parameters.

The system (synthesis part) is configured to synthesize an output multi-channel audio signal based on extracted downmix of multi-channel audio signals and metadata.

Figure 2:
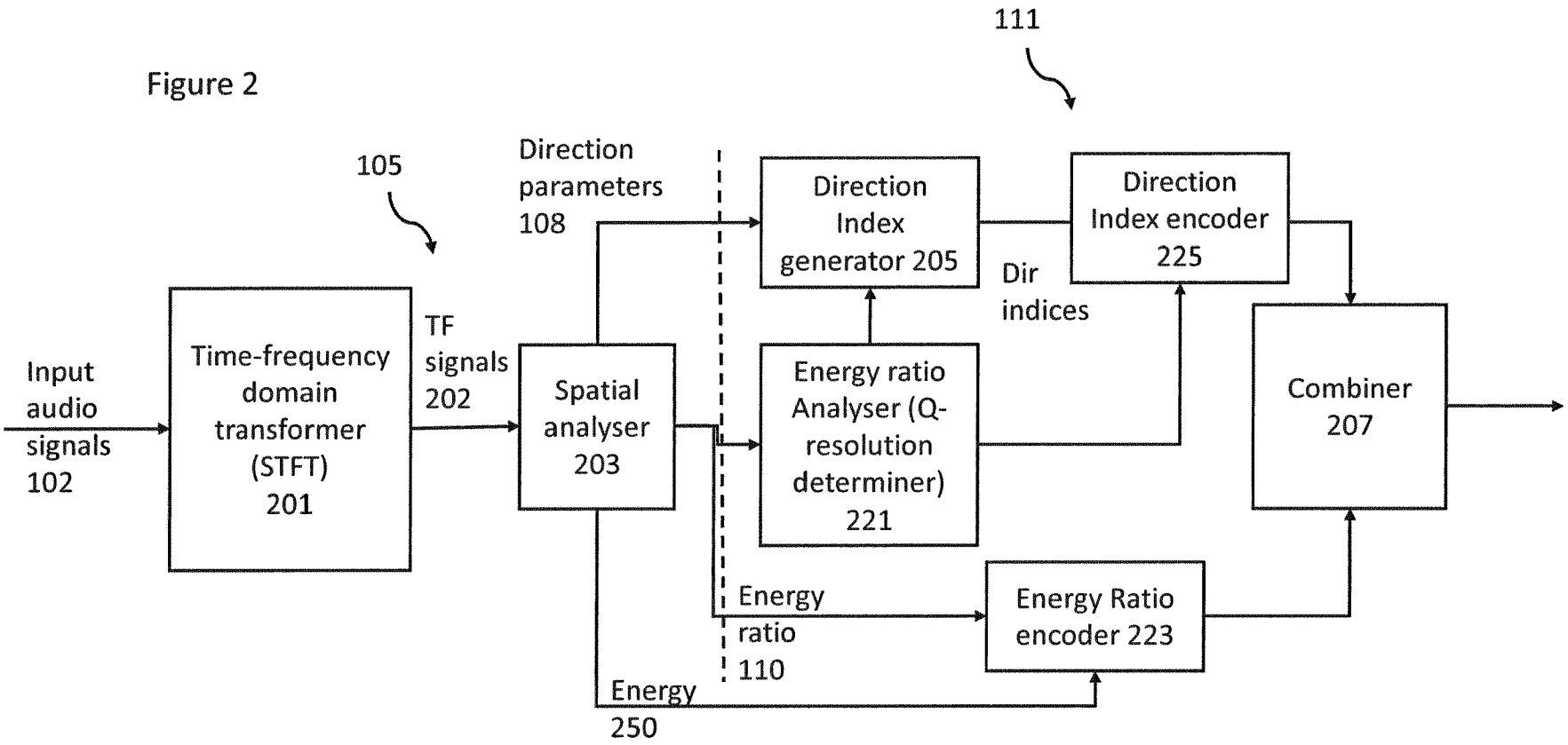
FIG. 2 shows schematically the metadata encoder according to some embodiments.

With respect to FIG. 2 an example analysis processor 105 and Metadata encoder/quantizer 111 (as shown in FIG. 1) according to some embodiments is described in further detail.

The analysis processor 105 in some embodiments comprises a time-frequency domain transformer 201.

In some embodiments the time-frequency domain transformer 201 is configured to receive the multi-channel signals 102 and apply a suitable time to frequency domain transform such as a Short Time Fourier Transform (STFT) in order to convert the input time domain signals into a suitable time-frequency signals. These time-frequency signals may be passed to a spatial analyser 203 and to a signal analyser 205.

Thus for example the time-frequency signals 202 may be represented in the time-frequency domain representation by $$s_i(b,n),$$

where b is the frequency bin index and n is the time-frequency block (frame) index and i is the channel index. In another expression, n can be considered as a time index with a lower sampling rate than that of the original time-domain signals. These frequency bins can be grouped into subbands that group one or more of the bins into a subband of a band index k=0, . . . , K−1. Each subband k has a lowest bin $b_{k,low}$ and a highest bin $b_{k,high}$, and the subband contains all bins from $b_{k,low}$ to $b_{k,high}$. The widths of the subbands can approximate any suitable distribution. For example the Equivalent rectangular bandwidth (ERB) scale or the Bark scale.

In some embodiments the analysis processor 105 comprises a spatial analyser 203. The spatial analyser 203 may be configured to receive the time-frequency signals 202 and based on these signals estimate direction parameters 108. The direction parameters may be determined based on any audio based 'direction' determination.

For example in some embodiments the spatial analyser 203 is configured to estimate the direction with two or more signal inputs. This represents the simplest configuration to estimate a 'direction', more complex processing may be performed with even more signals.

The spatial analyser 203 may thus be configured to provide at least one azimuth and elevation for each frequency band and temporal time-frequency block within a frame of an audio signal, denoted as azimuth φ(k,n) and elevation θ(k,n). The direction parameters 108 may be also be passed to a direction index generator 205.

The spatial analyser 203 may also be configured to determine an energy ratio parameter 110. The energy ratio may be considered to be a determination of the energy of the audio signal which can be considered to arrive from a direction. The direct-to-total energy ratio r(k,n) can be estimated, e.g., using a stability measure of the directional estimate, or using any correlation measure, or any other suitable method to obtain a ratio parameter. The energy ratio may be passed to an energy ratio analyser 221 and an energy ratio combiner 223.

Therefore in summary the analysis processor is configured to receive time domain multichannel or other format such as microphone or ambisonic audio signals.

Following this the analysis processor may apply a time domain to frequency domain transform (e.g. STFT) to generate suitable time-frequency domain signals for analysis and then apply direction analysis to determine direction and energy ratio parameters.

The analysis processor may then be configured to output the determined parameters.

Although directions and ratios are here expressed for each time index n, in some embodiments the parameters may be combined over several time indices. Same applies for the frequency axis, as has been expressed, the direction of several frequency bins b could be expressed by one direction parameter in band k consisting of several frequency bins b. The same applies for all of the discussed spatial parameters herein.

As also shown in FIG. 2 an example metadata encoder/quantizer 111 is shown according to some embodiments.

The metadata encoder/quantizer 111 may comprise an energy ratio analyser (or quantization resolution determiner) 221. The energy ratio analyser 221 may be configured to receive the energy ratios and from the analysis generate a quantization resolution for the direction parameters (in other words a quantization resolution for elevation and azimuth values) for all of the time-frequency blocks in the frame. This bit allocation may for example be defined by bits_dir0[0:N−1][0:M−1].

The metadata encoder/quantizer 111 may comprise a direction index generator 205. The direction index generator 205 is configured to receive the direction parameters (such as the azimuth φ(k, n) and elevation θ(k, n) 108 and the quantization bit allocation and from this generate a quantized output. In some embodiments the quantization is based on an arrangement of spheres forming a spherical grid arranged in rings on a 'surface' sphere which are defined by a look up table defined by the determined quantization resolution. In other words the spherical grid uses the idea of covering a sphere with smaller spheres and considering the centres of the smaller spheres as points defining a grid of almost equidistant directions. The smaller spheres therefore define cones or solid angles about the centre point which can be indexed according to any suitable indexing algorithm. Although spherical quantization is described here any suitable quantization, linear or non-linear may be used.

For example in some embodiments the bits for direction parameters (azimuth and elevation) are allocated according to the table bits_direction[ ]; if the energy ratio has the index i, the number of bits for the direction is bits_direction[i].

```
const short bits_direction[ ] = {
3, 5, 6, 8, 9, 10, 11, 11};
```

The structure of the direction quantizers for different bit resolutions is given by the following variables:

```
const short no_theta[ ] = /* from 1 to 11 bits */
{/*1, - 1 bit
1,*/    /* 2 bits */
1,      /* 3 bits */
2,      /* 4 bits */
4,      /* 5 bits */
5,      /* 6 bits */
6,      /* 7 bits */
7,      /* 8 bits */
10,     /* 9 bits */
14,     /* 10 bits */
19      /* 11 bits */
};
const short no_phi[ ] [MAX_NO_THETA] = /* from 1 to 11 bits*/
{
{2},
{4},
{8},
{12,4}, /* no points at poles */
{12,7,2,1},
{14,13,9,2,1},
{22,21,17, 11,3,1},
{33,32,29,23,17,9,1},
{48,47,45,41,35,28,20,12,2,1},
{60,60,58,56,54,50,46,41,36,30,23,17,10,1},
{89,89,88,86,84,81,77,73,68,63,57,51,44,38,30,23,15,8,1}
};
```

'no_theta' corresponds to the number of elevation values in the 'North hemisphere' of the sphere of directions, including the Equator. 'no_phi' corresponds to the number of azimuth values at each elevation for each quantizer.

For instance for 5 bits there are 4 elevation values corresponding to [0, 30, 60, 90] and 4−1=3 negative elevation values [−30, −60, −90]. For the first elevation value, 0, there are 12 equidistant azimuth values, for the elevation values 30 and −30 there are 7 equidistant azimuth values and so on.

All quantization structures with the exception of the structure corresponding to 4 bits have the difference between consecutive elevation values given by 90 degrees divided by the number of elevation values 'no_theta'. The structure corresponding to 4 bits has points only for the elevation having value of 0 and +45 degrees. There are no points under the Equator line for this structure. This is an example and any other suitable distribution may be implemented. For example in some embodiments there may be implemented a spherical grid for 4 bits that has points also under the Equator. Similarly the 3 bits distribution may be spread on the sphere or restricted to the Equator only.

The quantization indices for sub-bands within a group of time-blocks may then be passed to a direction index encoder 225. The direction index encoder 225 may then be configured to encode the index values on a sub-band by sub-band basis.

The direction index encoder 225 thus may be configured to reduce the allocated number of bits, bits_dir1[0:N−1][0:M−1], such that the sum of the allocated bits equals the number of available bits left after encoding the energy ratios.

The reduction of the number of initially allocated bits, in other words bits_dir1[0:N−1][0:M−1] from bits_dir0[0:N−1][0:M−1] may be implemented in some embodiments by:

Firstly uniformly diminishing the number of bits across time/frequency block with an amount of bits given by the integer division between the bits to be reduced and the number of time-frequency blocks;

Secondly, the bits that still need to be subtracted are subtracted one per time-frequency block starting with sub-band 0, time-frequency block 0.

This may be implemented for example by the following c code:

```
void
only_reduce_bits_direction(short
bits_dir0[MASA_MAXIMUM_CODING_SUBBANDS] [MASA_SUBFRAMES],
  short max_bits, short reduce_bits, short coding_subbands, short
no_subframes, IVAS_MASA_QDIRECTION * qdirection)
{
  /* does not update the q_direction structure */
  int j, k, bits = 0, red_times, rem, n = 0;
  /* keep original allocation */
  for (j = 0; j < coding_subbands; j++)
  {
    for (k = 0; k < no_subframes; k++)
    {
      qdirection->bits_sph_idx[j] [k] = bits_dir0[j] [k];
    }
  }
  if (reduce_bits > 0)
  {
    red_times = reduce_bits / (coding_subbands*no_subframes); /*
number of complete reductions by 1 bit */
    for (j = 0; j < coding_subbands; j++)
    {
      for (k = 0; k < no_subframes; k++)
      {
        bits_dir0[j] [k] −= red_times;
        if (bits_dir0[j] [k] < 0)
        {
          reduce_bits += −bits_dir0[j] [k];
          bits_dir0[j] [k] = 0;
        }
      }
    }
    rem = reduce_bits − coding_subbands*no_subframes*red_times;
    for (j = 0; j < coding_subbands; j++)
    {
      for (k = 0; k < no_subframes; k++)
      {
        if ((n < rem) && (bits_dir0[j] [k] > 0))
        {
          bits_dir0[j] [k] −= 1;
          n++;
        }
      }
    }
  }
  return;
}
```

In some embodiments, a minimum number of bits, larger than 0, may be imposed for each block.

The direction index encoder 225 may then be configured to implement the reduced number of bits allowed on a sub-band by sub-band basis.

For example the direction index encoder 225 may be configured to determine based on a calculated number of allowed bits for a current sub-band from the first sub-band to the penultimate sub-band. In other words bits_allowed=sum(bits_dir1[i][0:M−1]) from i=1 to N−1.

The direction index encoder may then be configured to attempt to encode the direction parameter indexes using a suitable entropy coding and determine how many bits are required for the current sub-band (bits_ec). Where this is less than a suitable fixed rate encoding mechanism using the determined reduced allocated number of bits, bits_fixed=bits_allowed, then the entropy coding is selected. Otherwise the fixed rate encoding method is selected.

Furthermore one bit is used to indicate the method selected.

In other words the number of bits used to encode the sub-band direction index is:

$$nb=\min(\text{bits_fixed},\text{bits_}ec)+1;$$

The direction index encoder may then be configured to determine whether there are bits remaining from the sub-band 'pool' of available bits.

For example the direction index encoder 225 may be configured to determine a difference value diff=(allowed_bits−*nb*)

Where diff>0, in other words there are unused bits from the allocation then these bits may be redistributed to succeeding sub-bands. For example by updating the distribution defined by the array bits_dir1[i+1:N−1][0:M−1].

Where diff=0 or <0 then subtract one bit from the allocation from the succeeding sub-band allocation. For example by updating the distribution defined by the array bits_dir1[i+1][0]

Having encoded all except the last sub-band then the last sub-band index values are encoded using a fixed rate encoding using a bit allocation defined by dir1[N−1][0:M−1] bits.

These may then be passed to a combiner 207.

In some embodiments the encoder comprises an energy ratio encoder 223. The energy ratio encoder 223 may be configured to receive the determined energy ratios (for example direct-to-total energy ratios, and furthermore diffuse-to-total energy ratios and remainder-to-total energy ratios) and encode/quantize these.

For example in some embodiments the energy ratio encoder 223 is configured to apply a scalar non-uniform quantization using 3 bits for each sub-band.

Furthermore in some embodiments the energy ratio encoder 223 is configured to generate one weighted average value per subband. In some embodiments this average is computed by taking into account the total energy of each time-frequency block and the weighting applied based on the subbands having more energy.

The energy ratio encoder 223 may then pass this to the combiner which is configured to combine the metadata and output a combined encoded metadata.

Figure 3:
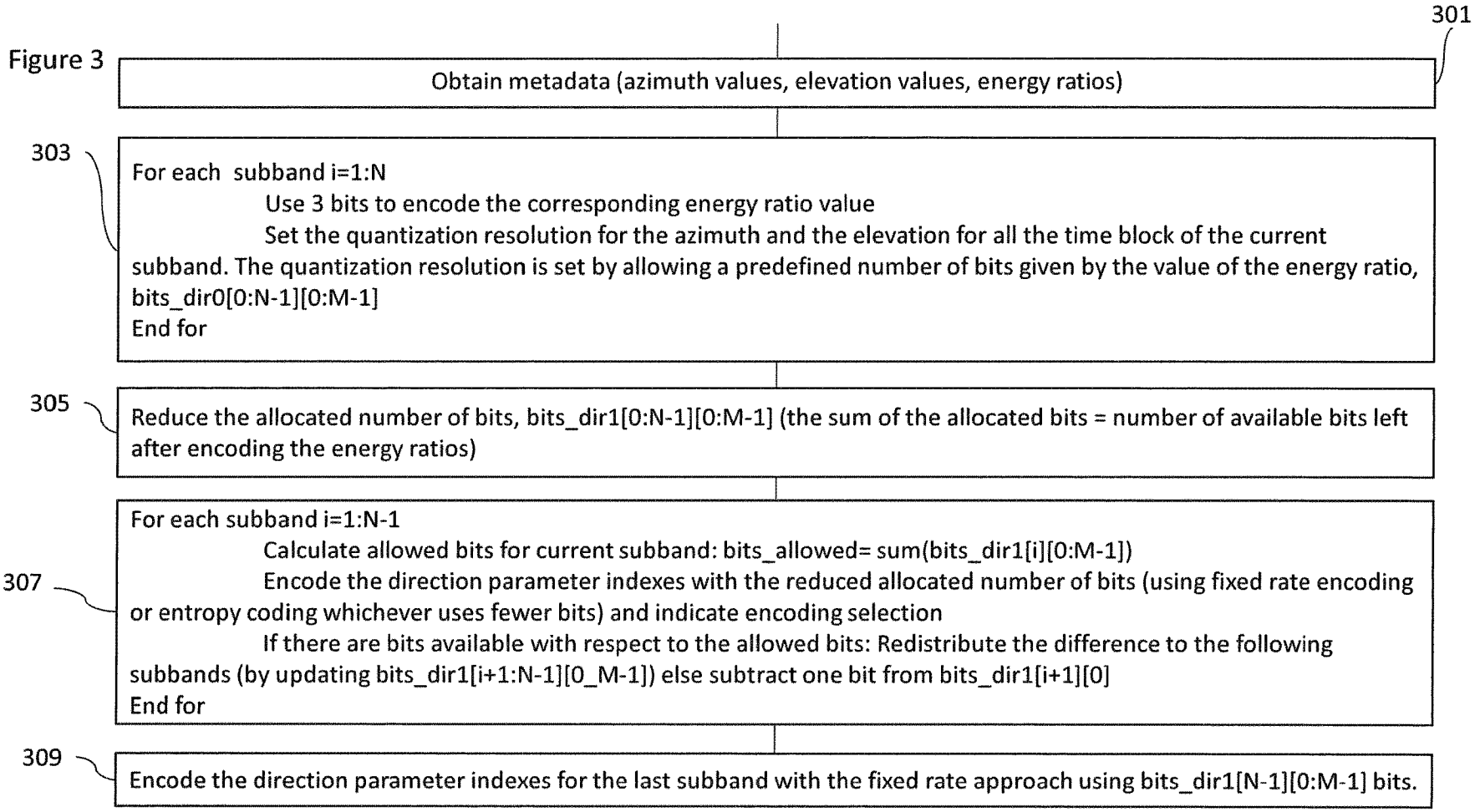
FIG. 3 show a flow diagram of the operation of the metadata encoder as shown in FIG. 2 according to some embodiments.

With respect to FIG. 3 is shown the operation of the Metadata encoder/quantizer 111 as shown in FIG. 2.

An initial operation is one of obtaining metadata (azimuth values, elevation values, energy ratios) as shown in FIG. 3 by step 301.

Having obtained the metadata for each sub-band (i=1:N) prepare an initial distribution or allocation and as shown by FIG. 3 by step 303: use 3 bits to encode the corresponding energy ratio value and then set the quantization resolution for the azimuth and the elevation for all the time-frequency blocks of the current subband. The quantization resolution is set by allowing a predefined number of bits given by the value of the energy ratio, bits_dir0[0:N−1][0:M−1].

Having generated an initial allocation reduce the allocated number of bits, bits_dir1 [0:N−1][0:M−1] (the sum of the allocated bits=number of available bits left after encoding the energy ratios) as shown in FIG. 3 by step 305.

Then implement the reduced bit allocation by implementing for sub-bands upto the penultimate (or if there are zero bits allocated for the last subband, then the "bit passing" procedure may be implemented only up to the subband before the penultimate subband (1:N−2)) sub-band (in other words For each subband i=1:N−1): calculate the allowed bits for current subband: bits_allowed=sum(bits_dir1[i][0:M−1]). Encode the direction parameter indexes with the reduced allocated number of bits (using fixed rate encoding or entropy coding whichever uses fewer bits) and indicate encoding selection. If there are bits available with respect to the allowed bits: Redistribute the difference to the following subbands (by updating bits_dir1 [i+1:N−1][0_M−1]) else subtract one bit from bits_dir1 [i+1][0]. This is shown in FIG. 3 by step 307.

Then for the final sub-band encode the direction parameter indexes for the last subband with the fixed rate approach using bits_dir1[N−1][0:M−1] bits as shown in FIG. 3 by step 309.

Figure 4:
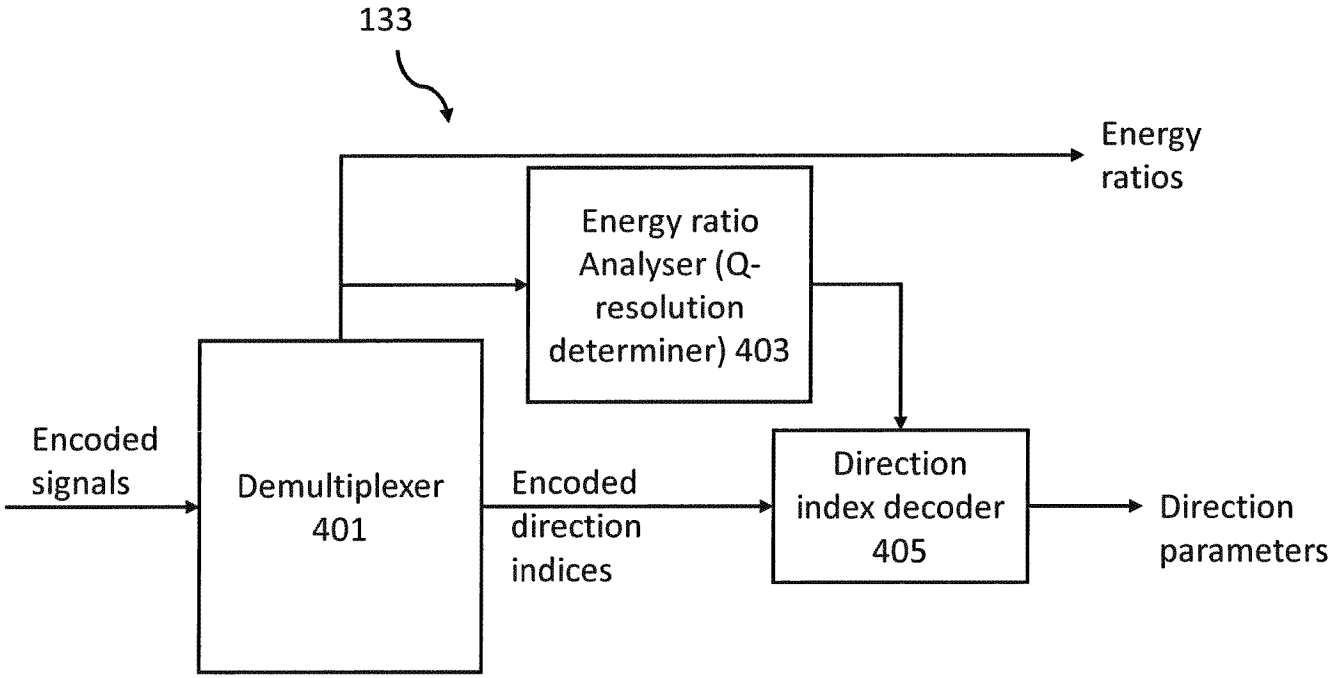
FIG. 4 shows schematically the metadata decoder according to some embodiments.

With respect to FIG. 4 is shown an example metadata extractor 137 as part of the decoder 133.

In some embodiments the encoded datastream is passed to a demultiplexer 401. The demultiplexer 401 is shown extracting the encoded energy ratios and the encoded direction indices and may also in some embodiments extract the other metadata and transport audio signals (not shown).

The energy ratios may be output and may also be passed to an energy ratio analyser (quantization resolution determiner) wherein a similar analysis to that performed within the metadata encoder energy ratio analyser (quantization resolution determiner) generates an initial bit allocation for the directional information. This is passed to the direction index decoder 405.

The direction index decoder 405 may furthermore receive from the demultiplexer encoded direction indices.

The direction index decoder 405 may be configured to determine a reduced bit allocation for directional values in a manner similar to that performed within the encoder.

The direction index decoder 405 may then furthermore be configured to read one bit to determine whether all of the elevation data is 0 (in other words the directional values are 2D).

Where the direction values are 3D then a count value for the last sub-band allocation nb_last is determined.

If the value nb_last is 0 then the last sub-band to be decoded is N−1 otherwise the last sub-band to be decoded is N.

The on a sub-band by sub-band basis from the first sub-band to the last sub-band (either N or N−1 according to the previous determination) then the direction index decoder 405 is configured to determine whether the encoding of the current sub-band was encoded using a fixed rate or variable rate code.

Where there was a fixed rate code used at the encoder then the spherical index (or other index distribution) is read and decoded obtaining the elevation and azimuth values and the allocation of bits for the next sub-band is reduced by 1.

Where there was a variable rate code used at the encoder then the entropy encoded index is read and decoded to generate the elevation and azimuth values. Then the number of bits used in the entropy encoded information counted and the difference between the allowed bits for the current sub-band and the bits used in the entropy encoding determined. After this the difference bits are distributed for the succeeding sub-band(s).

Then the last sub-band is decoded based on the fixed rate code.

Where the direction values are 2D then for each sub-band the indices are decoded based on the fixed-rate encoded azimuth indices.

With respect to FIG. 5 is shown a flow diagram of the decoding of the example encoded bit stream is shown.

Thus for example a first operation would be to obtain metadata (azimuth values, elevation values, energy ratios) as shown in FIG. 5 by step 501.

Then the method may estimate the initial bit allocation for the directional information based on the energy ratio values as shown in FIG. 5 by step 503.

The available bit allocation may then be reduced, bits_dir1 [0:N−1][0:M−1] (the sum of the allocated bits=number of available bits left available for decoding the directional information) as shown in FIG. 5 by step 505.

A bit is then read to determine if all elevation data is 0 or not (2D data).

If the directional data is 3D then, as shown in FIG. 5 by step 509, count the number of bits available for last subband (nb_last), where (nb_last==0) then last_j=N−1 Else Last) =N;

For each subband from j=1: last_j−1

Read 1 bit to tell is the encoding was fixed rate or variable rate

If fixed rate encoding:

Read and decode the spherical indexes for the directional information, obtaining the elevation and azimuth values and reduce 1 bit from the bits for the next subband;

else read and decode the entropy encoded indexes for elevation and azimuth, Count the number of bits used in the entropy encoded information, Calculate the difference between the allowed bits for the current subband and the bits used in the entropy encoding and Distribute the difference bits for the next subband;

end for;

For each suband from j=last_j:N: Read end decode fixed rate encoded spherical indexes for the directional data If directional data is 2D then for each subband from j=1:N: Decode fixed rate encoded azimuth indexes as shown in FIG. 5 by step 511.

The entropy encoding/decoding of the azimuth and the elevation indexes in some embodiments may be implemented using a Golomb Rice encoding method with two possible values for the Golomb Rice parameter. In some embodiments the entropy coding may also be implemented using any suitable entropy coding technique (for example Huffman, arithmetic coding . . . ).

In some embodiments when encoding/decoding the elevation index there may be a couple of exceptions, for the cases where the number of bits used for quantization is less or equal to 3. For these case there is only one elevation value, therefore the index of the elevation need not be encoded/decoded and only the azimuth index is needed.

If all time-frequency blocks for one sub-band are using less than 4 bits then no bit is sent for the elevation encoding, otherwise, one bit is sent to specify the Golomb Rice parameter and the rest of the bits correspond to the Golomb Rice codes for the time-frequency blocks that use more than 3 bits. The Golomb Rice parameter is 1 or 0. The selection of the GR parameter value is based on the estimated bit consumption in each case and selecting the one with less bits.

This may for example be implemented using the following C code

```
short
decode_elevation(QDIRECTION * qdirection,
                 unsigned short * bitstream,
                 int * pbit_pos,
                 short j,
                 short subframes)
{
    short nr_NO_INDEX, nbits;
    int bit_pos;
    unsigned char byteBuffer;
    short k, GR_ord_elevation, nb;
```

-continued

```
    nr_NO_INDEX = 0;
    nbits = 0;
    bit_pos = *pbit_pos;
    for(k=0;k< subframes;k++)
    {
      if (qdirection->bits_sph_idx[j] [k] >0)
      {
        if (qdirection->bits_sph_idx[j] [k] <= 3)
        {
          qdirection->elevation_index[j] [k] = NO_INDEX;
          nr_NO_INDEX +=1;
          qdirection->elevation[j] [k] = 0;
        }
        else
        {
          qdirection->elevation_index[j] [k] = 0;
        }
      }
      else
      {
        qdirection->elevation_index[j] [k] = 0;
        nr_NO_INDEX ++;
      }
    }
    if (nr_NO_INDEX<masa_subframes)
    {
      bit_pos = read_inv_bit_buff(bitstream, &byteBuffer, bit_pos,
1);
      nbits+=1;
      GR_ord_elevation = GR_ORD_EL − byteBuffer;
      for(k=0;k< subframes;k++)
      {
        if (qdirection->elevation_index[j] [k] < NO_INDEX)
        {
          bit_pos = read_GR(bitstream,
&qdirection->elevation_index[j] [k], bit_pos, GR_ord_elevation, &nb);
          nbits += nb;
          qdirection->elevation[j] [k] =
deindex_elevation(&qdirection->elevation_index[j] [k],
qdirection->bits_sph_idx[j] [k]);
        }
        else
        {
          qdirection->elevation_index[j] [k] = 0;
          qdirection->elevation[j] [k] = 0;
        }
      }
    }
    else
    {
      for(k=0;k<masa_subframes;k++)
      {
        qdirection->elevation_index[j] [k] = 0;
        qdirection->elevation[j] [k] = 0;
      }
    }
    *pbit_pos = bit_pos;
    return nbits;
  }
```

The encoding/decoding of the azimuth may be implemented using Golomb Rice coding with two GR parameter values. The two values are 1 and 2. The selection of the GR parameter value is done by estimating the number of bits in both cases and selecting the one with less number of bits. A particular case is considered when at least one time-frequency block for one subband has the allocated number of bits less or equal to 1. If that is the case (the "use_context" case from the following C function), the corresponding block info is encoded with 1 or 0 bits based on the allocated number of bits, while the rest of the time-frequency blocks are encoding with GR encoding with parameter equal to 1.

```
short
decode_azimuth(QDIRECTION * qdirection,unsigned short * bitstream,int *
pbit_pos, short j, short subframes )
{
  int bit_pos;
  short nbits, nb, k;
  unsigned char use_context, byteBuffer;
  nbits = 0;
  bit_pos = *pbit_pos;
  use_context = 0;
  for(k=0;k< subframes;k++)
  {
    if (qdirection->bits_sph_idx[j] [k] <= 1)
    {
      use_context = 1;
    }
  }
  if (use_context == 1)
  {
    for(k=0;k< subframes;k++)
    {
      if (qdirection->bits_sph_idx[j] [k] == 0)
      {
        qdirection->azimuth_index[j] [k] = 0;
        qdirection->azimuth[j] [k] = 0;
      }
      else
      {
        if (qdirection->bits_sph_idx[j] [k] == 1)
        {
          bit_pos = read_inv_bit_buff(bitstream,
&byteBuffer, bit_pos, 1);
          qdirection->azimuth_index[j] [k] = (unsigned
short)byteBuffer;
          qdirection->azimuth[j] [k] =
qdirection->azimuth_index[j] [k]*(-180);
        }
        else
        {
          bit_pos = read_GR(bitstream,
&qdirection->azimuth_index[j] [k], bit_pos,
            GR_ORD_AZ-
(qdirection->bits_sph_idx[j] [k] == 2), &nb);
          nbits += nb;
          qdirection->azimuth[j] [k] =
deindex_azimuth(qdirection->azimuth_index[j] [k],
  qdirection->bits_sph_idx[j] [k],
qdirection->elevation_index[j] [k] );
        }
      }
    }
  }
  else
  {
    /* read GR_order */
    bit_pos = read_inv_bit_buff(bitstream, &byteBuffer, bit_pos,
1);
    nbits +=1;
    for(k=0;k< subframes;k++)
    {
      if (qdirection->bits_sph_idx[j] [k] >0)
      {
      bit_pos = read_GR(bitstream,
&qdirection->azimuth_index[j] [k], bit_pos, GR_ORD_AZ-byteBuffer, &nb);
      nbits += nb;
      qdirection->azimuth[j] [k] =
deindex_azimuth(qdirection->azimuth_index[j] [k],
  qdirection->bits_sph_idx[j] [k],
qdirection->elevation_index[j] [k] );
      }
      else
      {
        qdirection->azimuth[j] [k] = 0;
        qdirection->azimuth_index[j] [k] = 0;
      }
    }
  }
  *pbit_pos = bit_pos;
  return nbits;
}
```

In some embodiments the indexing of the azimuth values is implemented such that instead of assigning the index in increasing order of the azimuth value, the indexes are assigned in increasing order of the distance from the frontal direction. In other words, if the quantized azimuth values are −180, −135, −90, −45, 0, 45, 90, 135 they do not get the indexes: 0, 1, 2, 3, 4, 5, 6, 7, but rather 7, 5, 3, 1, 0, 2, 4, 6. This may in some embodiments ensure that azimuth index values are lower in average and the entropy coding is more efficient.

The overall encoding method, allowing transferring bits from one subband to another allows for better adaptability to the local data statistics.

Figure 6:
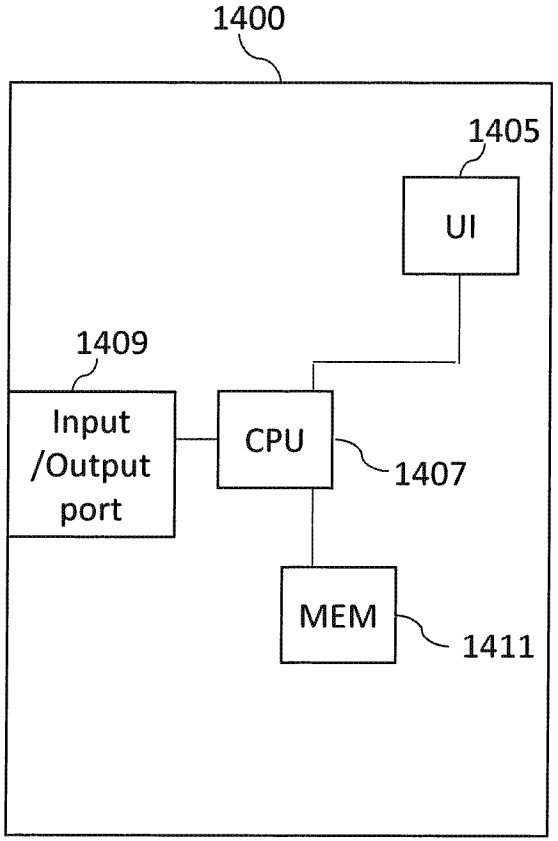
FIG. 6 shows schematically an example device suitable for implementing the apparatus shown.

With respect to FIG. 6 an example electronic device which may be used as the analysis or synthesis device is shown. The device may be any suitable electronics device or apparatus. For example in some embodiments the device 1400 is a mobile device, user equipment, tablet computer, computer, audio playback apparatus, etc.

In some embodiments the device 1400 comprises at least one processor or central processing unit 1407. The processor 1407 can be configured to execute various program codes such as the methods such as described herein.

In some embodiments the device 1400 comprises a memory 1411. In some embodiments the at least one processor 1407 is coupled to the memory 1411. The memory 1411 can be any suitable storage means. In some embodiments the memory 1411 comprises a program code section for storing program codes implementable upon the processor 1407. Furthermore in some embodiments the memory 1411 can further comprise a stored data section for storing data, for example data that has been processed or to be processed in accordance with the embodiments as described herein. The implemented program code stored within the program code section and the data stored within the stored data section can be retrieved by the processor 1407 whenever needed via the memory-processor coupling.

In some embodiments the device 1400 comprises a user interface 1405. The user interface 1405 can be coupled in some embodiments to the processor 1407. In some embodiments the processor 1407 can control the operation of the user interface 1405 and receive inputs from the user interface 1405. In some embodiments the user interface 1405 can enable a user to input commands to the device 1400, for example via a keypad. In some embodiments the user interface 1405 can enable the user to obtain information from the device 1400. For example the user interface 1405 may comprise a display configured to display information from the device 1400 to the user. The user interface 1405 can in some embodiments comprise a touch screen or touch interface capable of both enabling information to be entered to the device 1400 and further displaying information to the user of the device 1400. In some embodiments the user interface 1405 may be the user interface for communicating with the position determiner as described herein.

In some embodiments the device 1400 comprises an input/output port 1409. The input/output port 1409 in some embodiments comprises a transceiver. The transceiver in such embodiments can be coupled to the processor 1407 and configured to enable a communication with other apparatus or electronic devices, for example via a wireless communications network. The transceiver or any suitable transceiver or transmitter and/or receiver means can in some embodiments be configured to communicate with other electronic devices or apparatus via a wire or wired coupling.

The transceiver can communicate with further apparatus by any suitable known communications protocol. For example in some embodiments the transceiver can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The transceiver input/output port 1409 may be configured to receive the signals and in some embodiments determine the parameters as described herein by using the processor 1407 executing suitable code. Furthermore the device may generate a suitable downmix signal and parameter output to be transmitted to the synthesis device.

In some embodiments the device 1400 may be employed as at least part of the synthesis device. As such the input/output port 1409 may be configured to receive the downmix signals and in some embodiments the parameters determined at the capture device or processing device as described herein, and generate a suitable audio signal format output by using the processor 1407 executing suitable code. The input/output port 1409 may be coupled to any suitable audio output for example to a multichannel speaker system and/or headphones or similar.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including computer program code, the at least one memory and the computer program code configured to, with the at least one processor, cause the apparatus to at least to:

receive values for sub-bands of a frame of an audio signal, the values comprising at least one azimuth value, at least one elevation value and at least one energy ratio value for each sub-band;

determine an allocation of a first number of bits to encode the values of the frame, wherein the first number of bits are fixed;

encode the at least one energy ratio value for each sub band of the frame based on a defined allocation of a second number of bits from the first number of bits; and encode the at least one azimuth value and/or the at least one elevation value for each sub band of the frame based on a defined allocation of a third number of bits from the first number of bits, wherein the third number of bits is variably distributed on a sub-band-by-sub-band basis by the apparatus being further caused to: determine an initial estimate for the distribution of the third number of bits on a sub-band-by-sub-band basis, the initial estimate based on the at least one energy ratio value for the sub-band; and spatial quantize the at least one azimuth value and/or at least one elevation value based on the initial estimate for the distribution of the third number of bits on a sub-band-by-sub-band basis to generate at least one azimuth index and/or at least one elevation index for each sub-band.

2. The apparatus as claimed in claim 1, wherein the frame is divided into a plurality of subframes for each sub band, wherein at least one energy ratio value is associated with each of the plurality of subframes and wherein the apparatus caused to encode the at least one energy ratio value for each sub band of the frame based on a defined allocation of a second number of bits from the first number of bits is further caused to:

generate a weighted average of the at least one energy ratio value, for each sub band, from the energy ratio value associated with each of the plurality of subframes for the sub band; and encode the weighted average of the at least one energy ratio value based on the second number of bits.

3. The apparatus as claimed in claim 2, wherein the apparatus caused to encode the weighted average of the at least one energy ratio value based on the second number of bits is further caused to scalar non-uniform quantize the at least one weighted average of the at least one energy ratio value.

4. The apparatus as claimed in claim 1, wherein the apparatus caused to encode the at least one azimuth value and/or the at least one elevation value for each sub band of the frame based on a defined allocation of a third number of bits from the first number of bits, wherein the third number of bits is variably distributed on a sub-band-by-sub-band basis is further caused to encode on a sub-band-by-sub-band basis by determining a reduced distribution of the third number of bits on a sub-band-by-sub-band basis, the reduced estimate based on the initial distribution and the defined allocation of the second number of bits.

5. The apparatus as claimed in claim 4, wherein the apparatus caused to encode the at least one azimuth value and/or the at least one elevation value for each sub band of the frame based on a defined allocation of a third number of bits from the first number of bits, wherein the third number of bits is variably distributed on a sub-band-by-sub-band basis is further caused to encode on a sub-band-by-sub-band basis by being caused to:

determine an allocation of bits for encoding the at least one azimuth index and/or the at least one elevation index for a sub-band based on the reduced distribution;

estimate a number of bits required to entropy encode the at least one azimuth index and/or the at least one elevation index for the sub band;

entropy encode the at least one azimuth index and/or the at least one elevation index based on the number of bits required to entropy encode the at least one azimuth index and/or the at least one elevation index being less than the allocation of bits for encoding the at least one azimuth index and/or at least one elevation index for the sub-band and fixed rate encode based on the allocation of bits otherwise;

generate a signalling bit identifying the encoding of the at least one azimuth index and/or the at least one elevation index for the sub band; and distribute any available bits from the difference of the allocation of bits for encoding the at least one azimuth index and/or the at least one elevation index for the sub-band and the sum of the number of bits to encode the sub-band and the signalling bit for a further allocation of bits for encoding at least one azimuth index and/or at least one elevation index for a further sub-band or decreasing a further allocation of bits for encoding the at least one azimuth index and/or the at least one elevation index for the further sub-band by one bit otherwise.

6. The apparatus as claimed in claim 5, wherein the apparatus caused to encode the at least one azimuth value and/or the at least one elevation value of the frame based on a defined allocation of a third number of bits from the first number of bits, wherein the third number of bits is variably distributed on a sub-band-by-sub-band basis is further caused to encode on a sub-band-by-sub-band basis by being caused to:

determine an allocation of bits for encoding the at least one azimuth index and/or at least one elevation index for a last sub-band based on the reduced distribution; and fixed rate encode the at least one azimuth index and/or the at least one elevation index for the last sub-band based on the reduced distribution allocation of bits.

7. The apparatus as claimed in claim 5, wherein the apparatus caused to entropy encode the at least one azimuth index and/or the at least one elevation index based on the number of bits required to entropy encode the at least one azimuth index and/or the at least one elevation index is caused to Golomb Rice encode with two GR parameter values.

8. The apparatus as claimed in claim 4, wherein the apparatus caused to encode on a sub-band-by-sub-band basis by being caused to determine a reduced distribution of the third number of bits on a sub-band-by-sub-band basis, the reduced estimate based on the initial estimate and the defined allocation of the second number of bits is further caused to uniformly reduce on the sub-band-by-sub-band basis an allocation of bits for encoding the at least one azimuth index and/or the at least one elevation index.

9. The apparatus as claimed in claim 1, wherein the apparatus caused to encode the at least one azimuth value and/or the at least one elevation value for each sub band of the frame based on a defined allocation of a third number of bits from the first number of bits, wherein the third number of bits is variably distributed on a sub-band-by-sub-band basis is further caused to for at least one of:

assign indexes for encoding in increasing order of the distance from a frontal direction; and assign the index in increasing order of the azimuth value.

10. The apparatus as claimed in claim 1, wherein the apparatus is further caused to: store and/or transmit the encoded at least one energy ratio value for each sub band of the frame and at least one azimuth value and/or at least one elevation value.

11. An apparatus comprising at least one processor and at least one memory including computer program code, the at least one memory and the computer program code configured to, with the at least one processor, cause the apparatus to at least to:

receive encoded values for sub-bands of a frame of an audio signal, the values comprising at least one azimuth index, at least one elevation index and at least one energy ratio value for each sub-band of the frame; and decode the encoded values based on a defined allocation of bits wherein decoding the at least one azimuth index and/or at least one elevation index for each sub band of the frame uses a variably distributed bit allocation on a sub-band-by-sub-band basis, by being further caused to:

determine an initial allocation of bits distribution used to decode the at least one azimuth index and/or at least one elevation index for each sub-band based on the at least one energy ratio value for each sub-band;

determine a reduced allocation of bits distribution based on the initial allocation of bits distribution and an allocation of bits distribution for decoding the at least one energy ratio value of the frame; and decode the at least one azimuth index and/or at least one elevation index of each sub band of the frame based on the reduced allocation of bits distribution.

12. The apparatus as claimed in claim 11, wherein the apparatus caused to decode the at least one azimuth index and/or the at least one elevation index of the frame based on the reduced allocation of bits distribution is further caused to:

determine an allocation of bits for decoding the at least one azimuth index and/or at least one elevation index for a sub-band based on the reduced distribution;

entropy decode the at least one azimuth index and/or the at least one elevation index based on a signalling bit indicating entropy encoding and fixed rate decoding otherwise; and distribute any available bits from the difference of the allocation of bits for decoding the at least one azimuth index and/or at least one elevation index for the sub-band and the sum of the number of bits to decode the sub-band and the signalling bit for a further allocation of bits for decoding at least one azimuth index and/or at least one elevation index for the further sub-band or decreasing a further allocation of bits for decoding the at least one azimuth index and/or the at least one elevation index for the further sub-band by one bit otherwise.

13. The apparatus as claimed in claim 12, wherein the apparatus caused to decode the at least one azimuth index and/or the at least one elevation index of the frame based on the reduced allocation of bits distribution is caused to:

determine an allocation of bits for decoding the at least one azimuth index and/or the at least one elevation index for a last sub-band based on the reduced distribution; and fixed rate decode the at least one azimuth index and/or the at least one elevation index for a last sub-band based on the reduced distribution allocation of bits.

14. The apparatus as claimed in claim 12, wherein the apparatus caused to entropy decode the at least one azimuth index and/or the at least one elevation index is caused to Golomb Rice decode with two GR parameter values.

15. A method comprising:

receiving values for sub-bands of a frame of an audio signal, the values comprising at least one azimuth value, at least one elevation value and at least one energy ratio value for each sub-band;

determining an allocation of first number of bits to encode the values of the frame, wherein the first number of bits are fixed;

encoding the at least one energy ratio value for each sub band of the frame based on a defined allocation of a second number of bits from the first number of bits; and encoding the at least one azimuth value and/or the at least one elevation value for each sub band of the frame based on a defined allocation of a third number of bits from the first number of bits, wherein the third number of bits is variably distributed on a sub-band-by-sub-band basis by comprising: determining an initial estimate for the distribution of the third number of bits on a sub-band-by-sub-band basis, the initial estimate based on the at least one energy ratio value for the sub-band; and spatial quantizing the at least one azimuth value and/or at least one elevation value based on the initial estimate for the distribution of the third number of bits on a sub-band-by-sub-band basis to generate at least one azimuth index and/or at least one elevation index for each sub-band.

16. The method as claimed in claim 15, wherein the frame is divided into a plurality of subframes for each sub band, wherein at least one energy ratio value is associated with each of the plurality of subframes and wherein encoding the at least one energy ratio values for each sub band of the frame based on a defined allocation of a second number of bits from the first number of bits further comprises:

generating a weighted average, for each sub band, from the at least one energy value associated with each of the plurality of subframes for the sub band; and encoding the weighted average of the at least one energy ratio value based on the second number of bits.

17. A method comprising:

receiving encoded values for sub-bands of a frame of an audio signal, the values comprising at least one azimuth index, at least one elevation index and at least one energy ratio value for each sub-band; and decoding the encoded values based on a defined allocation of bits wherein decoding the at least one azimuth index and/or the at least one elevation index of the frame uses a variably distributed bit allocation on a sub-band-by-sub-band basis by:

determining an initial allocation of bits distribution used to decode the at least one azimuth index and/or at least one elevation index for each sub-band based on the at least one energy ratio value for each sub-band;

determining a reduced allocation of bits distribution based on the initial allocation of bits distribution and an allocation of bits distribution for decoding the at least one energy ratio value of the frame; and decoding the at least one azimuth index and/or at least one elevation index of the frame based on the reduced allocation of bits distribution.

* * * * *